US008616595B2

(12) United States Patent
Wellborn, Sr. et al.

(10) Patent No.: US 8,616,595 B2
(45) Date of Patent: Dec. 31, 2013

(54) ACTUATOR ASSEMBLY FOR A VEHICLE DOOR LATCH

(75) Inventors: Carl W. Wellborn, Sr., Detroit, MI (US); Rory Windrim, Davisburg, MI (US); Hesham A Ezzat, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 296 days.

(21) Appl. No.: 13/075,015

(22) Filed: Mar. 29, 2011

(65) Prior Publication Data

US 2012/0248798 A1 Oct. 4, 2012

(51) Int. Cl.
*E05B 3/00* (2006.01)
*E05C 1/02* (2006.01)

(52) U.S. Cl.
USPC ..... 292/336.3; 292/DIG. 31

(58) Field of Classification Search
USPC ..... 292/336.3, DIG. 31
See application file for complete search history.

(56) References Cited

U.S. PATENT DOCUMENTS

| | | | | |
|---|---|---|---|---|
| 4,482,179 | A * | 11/1984 | Johnson | 292/336.3 |
| 4,872,366 | A * | 10/1989 | Appleby et al. | 74/501.6 |
| 4,889,373 | A * | 12/1989 | Ward et al. | 292/336.3 |
| 6,598,912 | B2 * | 7/2003 | Hillgaertner et al. | 292/225 |
| 6,923,481 | B2 * | 8/2005 | Bruderick et al. | 292/336.3 |
| 6,929,294 | B2 * | 8/2005 | Byrla et al. | 292/336.3 |
| 7,204,530 | B2 * | 4/2007 | Lee | 292/336.3 |

* cited by examiner

*Primary Examiner* — Carlos Lugo
(74) *Attorney, Agent, or Firm* — Ingrassia Fisher & Lorenz, P.C.

(57) ABSTRACT

An actuator assembly for a vehicle door latch includes, but is not limited to, a pushable member. The actuator assembly further includes a mounting member connected to the pushable member and configured for connection to a vehicle door. The mounting member is further configured to mount the pushable member to the vehicle door in a manner that enables the pushable member to be pushed from a closed position to an open position. The actuator assembly further includes a latch engaging member connected to the mounting member and configured for engagement with a latch of the vehicle door. The latch engaging member is configured to move the latch from a latched position to an unlatched position when the pushable member moves from the closed position to the open position, whereby the user is enabled to both unlatch the vehicle door and open the vehicle door with a single pushing movement.

18 Claims, 8 Drawing Sheets

ACTUATOR ASSEMBLY FOR A VEHICLE DOOR LATCH

TECHNICAL FIELD

The technical field generally relates to a vehicle door, and more particularly relates to an actuator assembly for a vehicle door latch.

BACKGROUND

A conventional vehicle includes multiple vehicle doors, each of which includes a latch (hereinafter "vehicle door latch") that is configured to engage a structure on the vehicle. When the vehicle door latch is engaged with the structure on the vehicle, the vehicle door latch secures the vehicle door in a closed state. The vehicle door latch is typically mounted internally to the vehicle door and is not accessible to a user.

Actuator assemblies that are configured to actuate the vehicle door latch are commonly assembled to the vehicle door in a position that is accessible to user from inside of the vehicle and allow the user to open the vehicle door from the inside. To operate a conventional actuator assembly, the user first grasps the actuator assembly, then pulls on the actuator assembly to unlatch the vehicle door latch, and then, while continuing to pull on the actuator assembly, pushes on the vehicle door to swing it open, typically with an elbow or shoulder.

While conventional actuator assemblies are adequate, there is room for improvement. The operation of a conventional actuator assembly requires the user to have a certain amount of manual dexterity in order to segregate one or two fingers from the others in order to properly grasp or engage the actuator assembly. Furthermore, the act of pulling on the actuator assembly with the user's hand while simultaneously pushing on the vehicle door with the user's elbow and/or shoulder requires the user to have a generally unencumbered range of motion for the arm closest to the vehicle door. Furthermore, conventional latches do not serve as grab handles. Typically, while opening the door, the user must release the latch and quickly reach for a separate grab handle to prevent the vehicle door from swinging open in an uncontrolled manner. In the event that a user is injured, ill, afflicted with an illness or suffers from a condition that limits the user's mobility or range of motion, the user may be unable to simultaneously pull on the actuator assembly, push on the vehicle door, and then quickly relocate their hand to a grab handle to control the vehicle door as it swings open.

SUMMARY

An actuator assembly for a vehicle door latch is disclosed herein.

In a first embodiment, the actuator assembly includes, but is not limited to, a pushable member that is configured for engagement by a user. The actuator assembly further includes a mounting member that is connected to the pushable member and that is configured for connection to a vehicle door. The mounting member is further configured to mount the pushable member to the vehicle door in a manner that enables the pushable member to be pushed by the user from a closed position to an open position. The actuator assembly further includes a latch engaging member that is connected to the mounting member and that is configured for engagement with a latch of the vehicle door. The latch engaging member is configured to move the latch from a latched position to an unlatched position when the pushable member moves from the closed position to the open position, whereby the user is enabled to both unlatch the vehicle door and open the vehicle door with a single pushing movement.

In another embodiment, the actuator assembly includes, but is not limited to, a pushable member that is configured for engagement by a user. The actuator assembly further includes a mounting member that is connected to the pushable member and that is configured for connection to a vehicle door. The mounting member is further configured to mount the pushable member to the vehicle door in a manner that enables the pushable member to be pushed by the user from a closed position to an open position. The actuator assembly further includes a biasing member that is connected to the pushable member and that is configured to bias the pushable member towards the closed position. The actuator assembly further includes a latch engaging member that is connected to the mounting member and that is configured for engagement with a latch of the vehicle door. The latch engaging member is configured to move the latch from a latched position to an unlatched position when the pushable member moves from the closed position to the open position, whereby the user is enabled to both unlatch the vehicle door and open the vehicle door with a single pushing movement.

In another embodiment, the actuator assembly includes, but is not limited to, a pushable member that is configured for engagement by a user. The actuator assembly further includes a mounting member that is connected to the pushable member and that is configured for connection to a vehicle door. The mounting member is further configured to mount the pushable member to the vehicle door in a manner that enables the pushable member to be pushed by the user from a closed position to an open position. The actuator assembly further includes a blocking member that is connected to the pushable member and that is configured to move between a blocking position and a non-blocking position. The blocking member obstructs movement of the pushable member from the closed position when the blocking member is in the blocking position and the blocking member permits movement of the pushable member from the closed position when the blocking member is in the non-blocking position. The actuator assembly further includes a latch engaging member that is connected to the mounting member and that is configured for engagement with a latch of the vehicle door. The latch engaging member is configured to move the latch from a latched position to an unlatched position when the pushable member moves from the closed position to the open position, whereby the user is enabled to both unlatch the vehicle door and open the vehicle door with a single pushing movement.

DESCRIPTION OF THE DRAWINGS

One or more embodiments will hereinafter be described in conjunction with the following drawing figures, wherein like numerals denote like elements.

DETAILED DESCRIPTION

The following detailed description is merely exemplary in nature and is not intended to limit application and uses. Furthermore, there is no intention to be bound by any expressed or implied theory presented in the preceding technical field, background, brief summary or the following detailed description.

An improved actuator assembly for a vehicle door latch is disclosed herein. The actuator assembly is configured to permit a user to unlatch the vehicle door latch and further permits the user to push open the vehicle door. Both of these tasks may be accomplished by the user with a single, continuous push. The actuator assembly includes a pushable member that is positioned on the vehicle door in any suitable and accessible location. The user may place their hand on the pushable member and push the pushable member to an open position to unlatch the vehicle door latch. In an embodiment, the pushable member may be obstructed from further movement beyond the open position. Accordingly, once the vehicle door is unlatched, the user may continue to push on the pushable member to move the vehicle door from a closed state to an open state. In some embodiments, the pushable member may also be used by the user to control the outward motion of the vehicle door as it swings open.

A further understanding of the above described actuator assembly for a vehicle door latch may be obtained through a review of the illustrations accompanying this application together with a review of the detailed description that follows.

Figure 1:
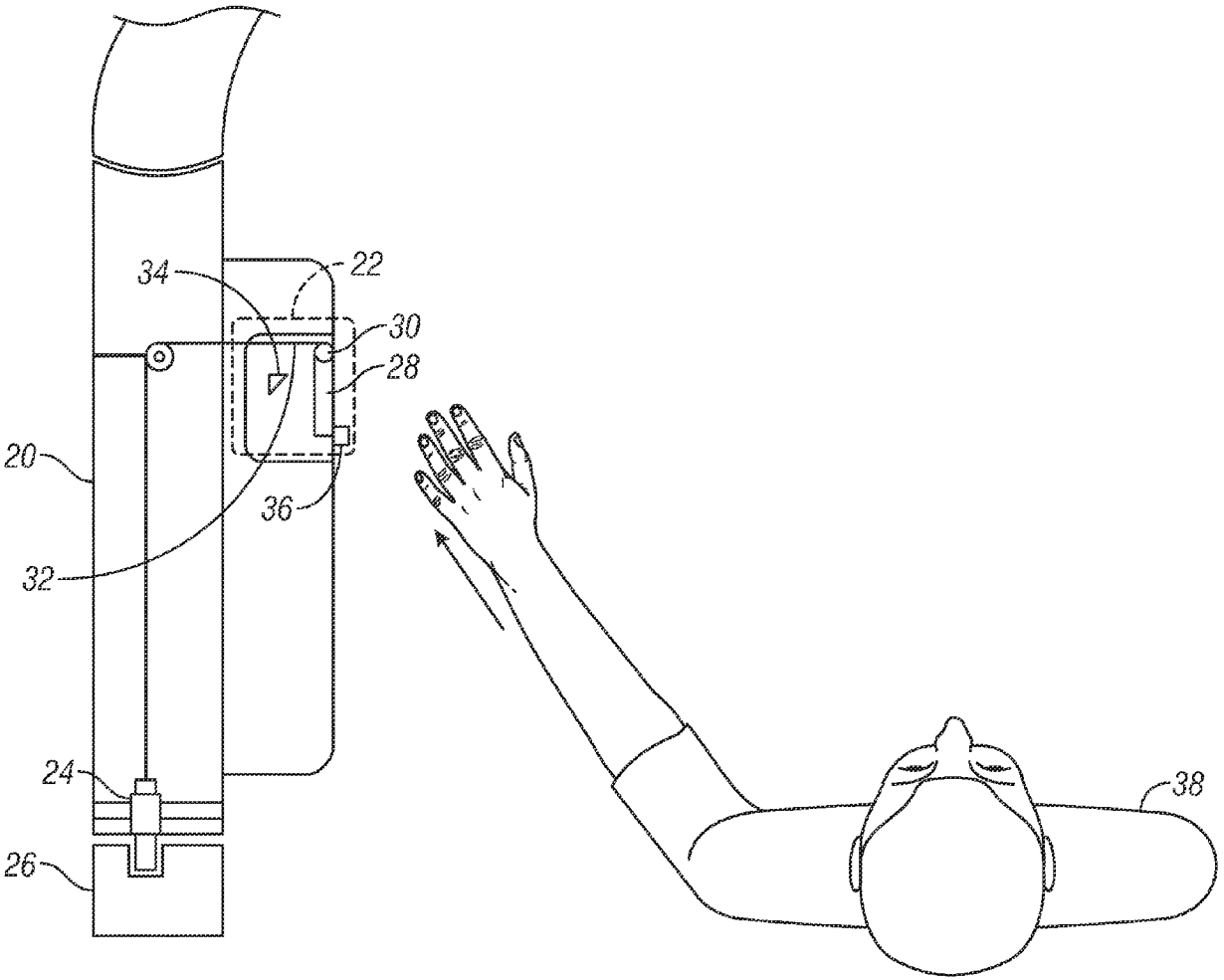
FIG. 1 is a schematic view illustrating a vehicle door equipped with an embodiment of an actuator assembly prior to actuation.

FIG. 1 is a schematic view illustrating a vehicle door 20 equipped with an embodiment of an actuator assembly 22 prior to actuation. Vehicle door 20 includes a vehicle door latch 24 that is configured to engage a structure of a vehicle such as B-pillar 26. Vehicle door latch 24 and B-pillar 26 cooperate to retain vehicle door 20 in a closed state when the vehicle door latch 24 is latched. Although FIG. 1 illustrates a driver's side door of a passenger car, it should be understood that the teaching herein are compatible with any vehicle door and with any type of vehicle.

Actuator assembly 22 includes a pushable member 28, a mounting member 30 and a latch engaging member 32. In the illustrated embodiment, actuator assembly 22 further includes a stopping member 34 and a stopping member 36. Actuator assembly 22 also includes a biasing member, not shown in FIG. 1.

Pushable member 28 may comprise any type of body, component or structure that is suited for pushing engagement by a user 38. In an embodiment, pushable member 28 may comprise a generally flat, rectangular body suitable for grasping with a hand of user 38. In other embodiments, any other suitable configuration may be employed. In an embodiment, pushable member 28 may be positioned at a location on an interior portion of vehicle door 20 where a hand of user 38 is likely to naturally contact vehicle door 20 when the user 38 reaches for vehicle door 20 to facilitate operation of actuator assembly 22.

Mounting member 30 is connected to pushable member 28 and is configured to mount pushable member 28 to vehicle door 20. Mounting member 30 and pushable member 28 may be joined in any suitable manner including through the use of fasteners, adhesives, welding, or any other method that is effective to join these two components. In the illustrated embodiment, mounting member 30 is a generally cylindrical pivot that is configured to be mounted within a generally circular opening (not shown) in vehicle door 20. Mounting member 30 is further configured to rotate with respect to the generally circular opening and, in this manner, permits pushable member 28 to pivot between a closed position (as shown in FIG. 1) and an open position (illustrated in FIG. 2). In other embodiments, mounting member 30 may take any suitable form that is effective to permit relative movement between pushable member 28 and vehicle door 20.

In the illustrated embodiment, latch engaging member 32 comprises a cable that is connected to vehicle door latch 24. In other embodiments, latch engaging member 32 may comprise a Bowden cable, a single rod, an arrangement of multiple rods, or any other structure that is effective to utilize the motion of pushable member 28 to unlatch vehicle door latch 24. Latch engaging member 32 may be connected to mounting member 30 via any suitable means including through the use of mechanical engagement, mechanical fasteners, adhesives, welding, or any other method that is effective to join latch engaging member 32 to mounting member 30.

Figure 2:
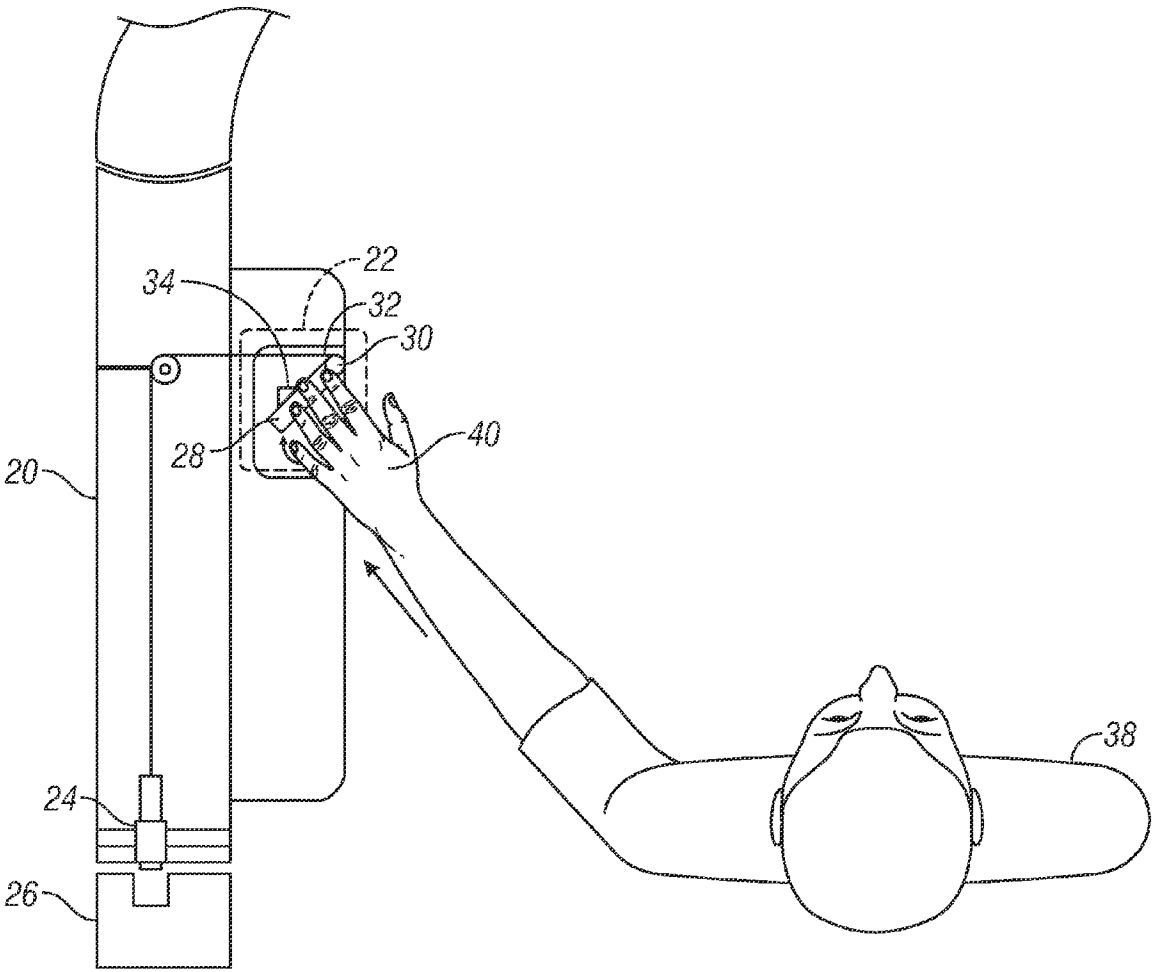
FIG. 2 is a schematic view illustrating the vehicle door of FIG. 1 during actuation of the actuator assembly.

FIG. 2 illustrates vehicle door 20 and actuator assembly 22 during actuation of actuator assembly 22. In FIG. 2, user 38 has pushed against movable member 28 with a hand 40. In other embodiments, user 38 may use any suitable and/or convenient body part or object to push against pushable member 28. When user 38 pushes on pushable member 28 and moves pushable member 28 from the closed position to the open position, the movement of pushable member 28 pulls on latch engaging member 32. This pulling motion, in turn, pulls on vehicle door latch 24, unlatching it. With vehicle door latch 24 in an unlatched state, vehicle door latch 24 becomes disengaged from B-pillar 26 and vehicle door 20 is a free to swing open.

With continuing reference to FIGS. 1-2, in the illustrated embodiment, the range of motion of pushable member 28 is limited by stopping member 34 at one end (when pushable member 28 is in the open position) and stopping member 36 at the other end (when pushable member 20 is in the closed position). Stopping member 34 may comprise any structure that is effective to obstruct movement of pushable member 28. In one example, stopping member 34 may comprise a rubber block attached at a suitable location on vehicle door 20 while in another embodiment, stopping member 34 may comprise a portion of vehicle door 20 itself. Similarly, stopping member 36 may also comprise any structure that is effective to obstruct movement of pushable member 28.

Figure 3:
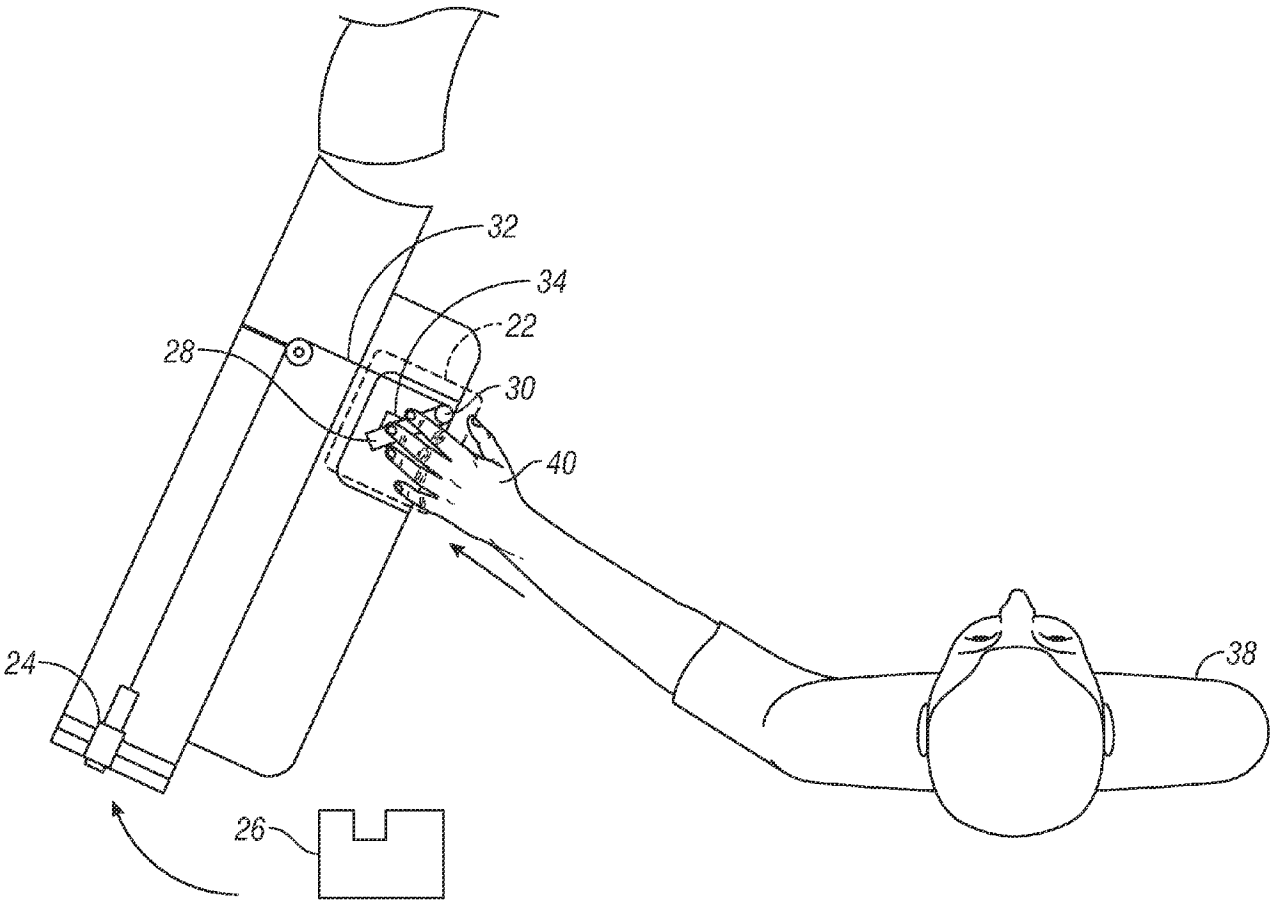
FIG. 3 is a schematic view illustrating the vehicle door of FIG. 2 as the vehicle door is being pushed open.

FIG. 3 is a schematic view illustrating vehicle door 20 as it is being pushed open. With pushable member 28 in the open position and impeded from movement beyond the open position by stopping member 34, the force of any continued pushing by user 38 against pushable member 28 is transmitted to vehicle door 20. Because vehicle door 20 is disengaged from B-pillar 26, vehicle door 20 begins to swing open.

Figure 4:
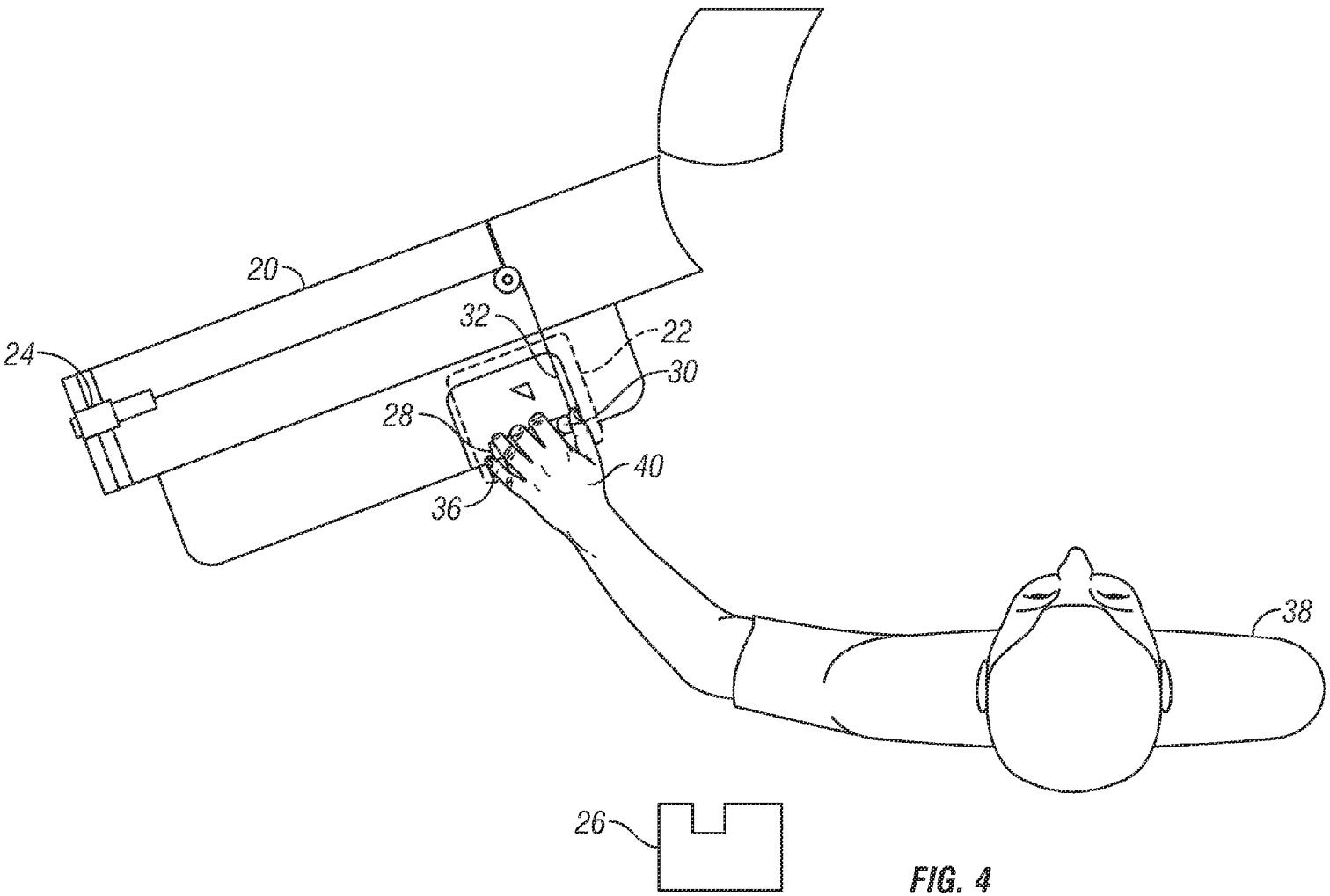
FIG. 4 is a schematic view of the vehicle door of FIG. 3 illustrating use of the actuator assembly to control the outward swinging motion of the vehicle door.

FIG. 4 is a schematic view of the vehicle door 20 illustrating use of actuator assembly 22 to control the swinging motion of vehicle door 20. As vehicle door 20 continues to swing in an outward direction, user 38 may engage with a backside of pushable member 28 and thereby grasp pushable member 28. User 38 may then pull on pushable member 28, thus causing pushable member 28 to swing back from the open position to the closed position. As pushable member 28 reaches the closed position, pushable member 28 will engage stopping member 36. Stopping member 36 impedes movement of pushable member 28 in a counterclockwise direction (from the perspective of FIG. 4) beyond the closed position. Once pushable member 28 has reached the closed position, pushable member 28 serves as a grab handle which user 38 may use to pull on vehicle door 20 and to thereby control the outward swinging motion of vehicle door 20. In some embodiments, actuator assembly 22 may be positioned at a location that is suitable to permit user 38 to use actuator assembly 22 to close vehicle door 20 as part of ingress into the vehicle.

Figure 5:
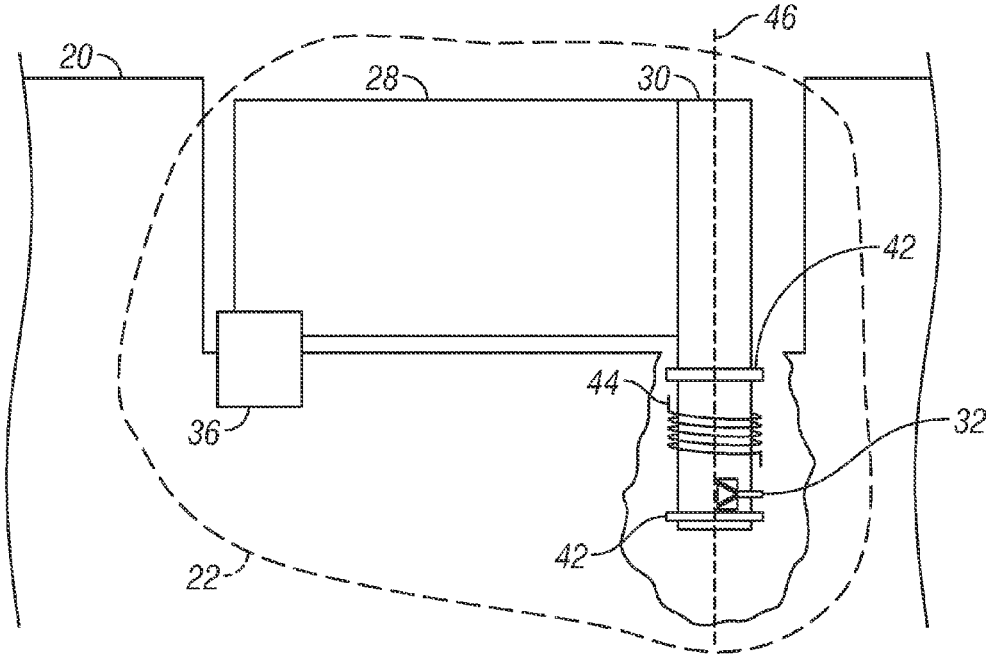
FIG. 5 is a schematic, fragmented, cutaway view illustrating additional structures of the actuator assembly of FIG. 1.

FIG. 5 is a schematic, fragmented, cutaway view of actuator assembly 22. This view is presented from the perspective of someone positioned inside the vehicle looking towards vehicle door 20. A portion of vehicle door 20 has been cut away to illustrate the mounting of mounting member 30 to vehicle door 20. Circular mounting brackets 42 are positioned internally within vehicle door 20 and are configured to receive a lower portion of mounting member 30. Mounting member 30 is configured to rotate with respect to circular mounting brackets 42 and thereby permits pushable member 28 to pivot with respect to vehicle door 20.

With continuing reference to FIGS. 1-5, latch engaging member 32 is attached to mounting member 30 via a mechanical engagement. In other embodiments, mechanical fasteners, welds, adhesives, or any other method of joining latch engaging member 32 to mounting member 30 may be employed. As pushable member 28 is pushed in an outboard direction, latch engaging member 32 will be pulled by the rotating motion of mounting member 30 and will begin to wrap around mounting member 30. In this manner, the lower portion of mounting member 30 acts as a camming surface which converts rotational motion into straight-line motion. In other embodiments, other structures and configurations may be employed to convert the outboard motion of pushable member 28 into a movement of latch engaging member 32 that will cause the latch engaging member 32 to actuate vehicle door latch 24.

A spring 44 is wrapped around the lower portion of mounting member 30. Spring 44 is configured to engage mounting member 30 in a manner that results in the biasing of pushable member 28 in an inboard direction towards the closed position. In the illustrated embodiment, spring 44 is a coil spring. In other embodiments, different types of springs may be employed without departing from the teachings of the present disclosure. In still other embodiments, any other type of biasing means effective to bias pushable member 28 towards the closed position may also be employed without departing from the teachings of the present disclosure.

Mounting member 30 has a longitudinal axis 46. In the embodiment illustrated in FIG. 5, longitudinal axis 46 is oriented substantially vertically. This orientation permits pushable member 28 to pivot through a horizontal plane. In other embodiments, mounting member 30 may be oriented differently when mounted to vehicle door 20.

Figure 6:
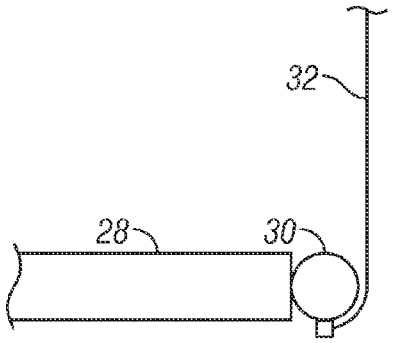
FIG. 6 is a schematic view illustrating a pushable member, a pivot, and a latch engaging member prior to actuation of the actuator assembly.
Figure 7:
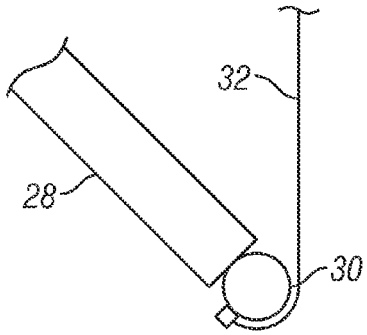
FIG. 7 is a schematic view illustrating the pushable member, the pivot, and the latch engaging member of FIG. 6 subsequent to actuation of the actuator assembly.

FIGS. 6-7 are schematic illustrations that depict the engagement between mounting member 30 and the latch engaging member 32. In FIG. 6, pushable member 28 is in the closed position and latch engaging member 32 is in its most relaxed state. With continuing reference to FIGS. 1-6, when pushable member 28 is in the closed position, latch engaging member 32 does not actuate vehicle door latch 24. In FIG. 7, pushable member 28 has been moved to the opened position. This movement causes mounting member 30 to rotate in a clockwise direction from the perspective of FIG. 7. As mounting member 30 rotates in a clockwise direction, latch engaging member 32 begins to wrap around mounting member 30 in a manner similar to a cable wrapping around a winch. This wrapping causes latch engaging member 32 to pull on vehicle door latch 24, thus actuating it.

Figure 8:
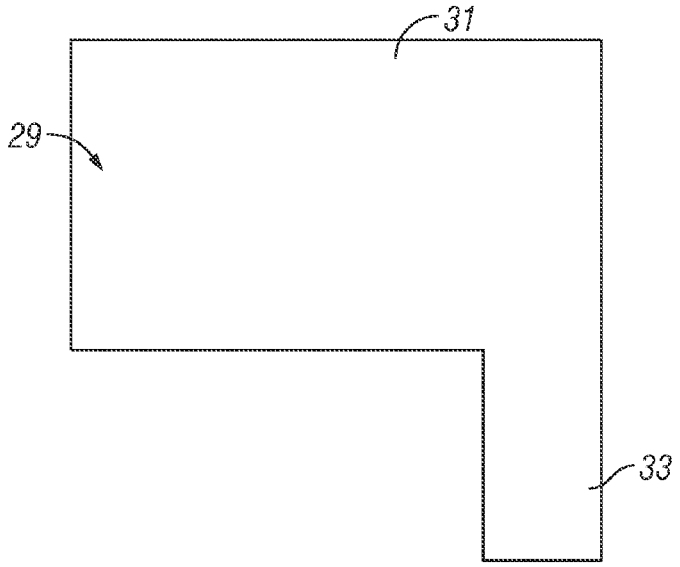
FIG. 8 is a schematic view illustrating an alternate embodiment of the pushable member and the pivot of the actuator assembly of FIG. 1.

FIG. 8 is a schematic view illustrating an alternate embodiment of pushable member 28 and mounting member 30 of actuator assembly 22, shown in FIG. 1. With continuing reference to FIGS. 1-8, in the embodiment illustrated in FIG. 8, pushable member 28 and mounting member 30 have been combined into a single component 29 that includes a pushable portion 31 and a mounting portion 33. Pushable portion 31 is configured to be engaged by user 38 while mounting portion 33 is configured to mount single component 29 directly to vehicle door 20.

Figure 9:
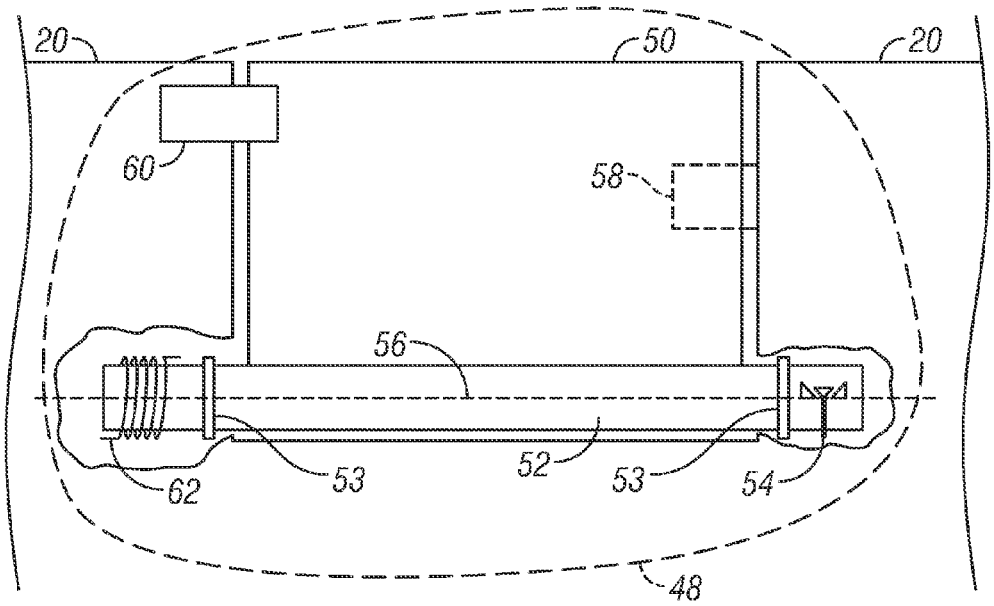
FIG. 9 is a schematic, fragmented, cutaway view illustrating another alternate embodiment of the actuator assembly of FIG. 1.

FIG. 9 is a schematic, fragmented, cutaway view illustrating an alternate embodiment 48 of actuator assembly 22 of FIG. 1. With continuing reference to FIGS. 1-9, alternate embodiment 48 includes a pushable member 50, a mounting member 52, and a latch engaging member 54. In alternate embodiment 48, mounting member 52 has a longitudinal axis 56 that is arranged in a substantially horizontal orientation. In the illustrated embodiment, longitudinal axis a substantially aligned in the direction of vehicle travel, allowing pushable member 50 to be positioned substantially flush with a portion of vehicle door 20. In other embodiments, mounting member 52 may be mounted in any desired horizontal orientation.

Circular mounting brackets 53 are attached to vehicle door 20 and are configured to receive mounting member 52. Mounting member 52 has a generally circular-cylindrical configuration that permits it to rotate with respect to circular mounting brackets 53. In this manner, mounting member 52 permits pivotal movement of pushable member 50 between a closed and an open position.

A stopping member 58 is mounted to vehicle door 20 and is positioned behind pushable member 50 to obstruct movement of pushable member 50 in an outboard direction. Stopping member 58 limits movement of pushable member 50 beyond the open position. Another stopping member 60 is mounted to vehicle door 20 in a position that obstructs inboard movement of pushable member 50. Stopping member 60 is positioned to obstruct pushable member 50 from moving beyond the closed position. Although alternate embodiment 48 illustrates the use of only two stopping members (e.g., stopping member 58 and stopping member 60), it should be understood that any suitable number of stopping members may be employed to limit the range of motion of pushable member 50.

Alternate embodiment 48 further includes a spring 62 that is configured to bias pushable member 50 in an inboard direction, against stopping member 60. This allows pushable member 50 to remain substantially flush with the vehicle door 20 when alternate embodiment 48 is not being utilized. When user 48 actuates alternate embodiment 48 and pushes pushable member 50 in an outboard direction, latch engaging member 54 begins to wrap around an end of mounting member 52 and, in this manner, actuates vehicle door latch 24. Therefore, in the same manner described above with respect to actuator assembly 22, a user 38 need only position their hand 40 up against pushable member 50 and push in an outboard direction to both unlatch vehicle door latch 24 and open vehicle door 20.

Figure 10:
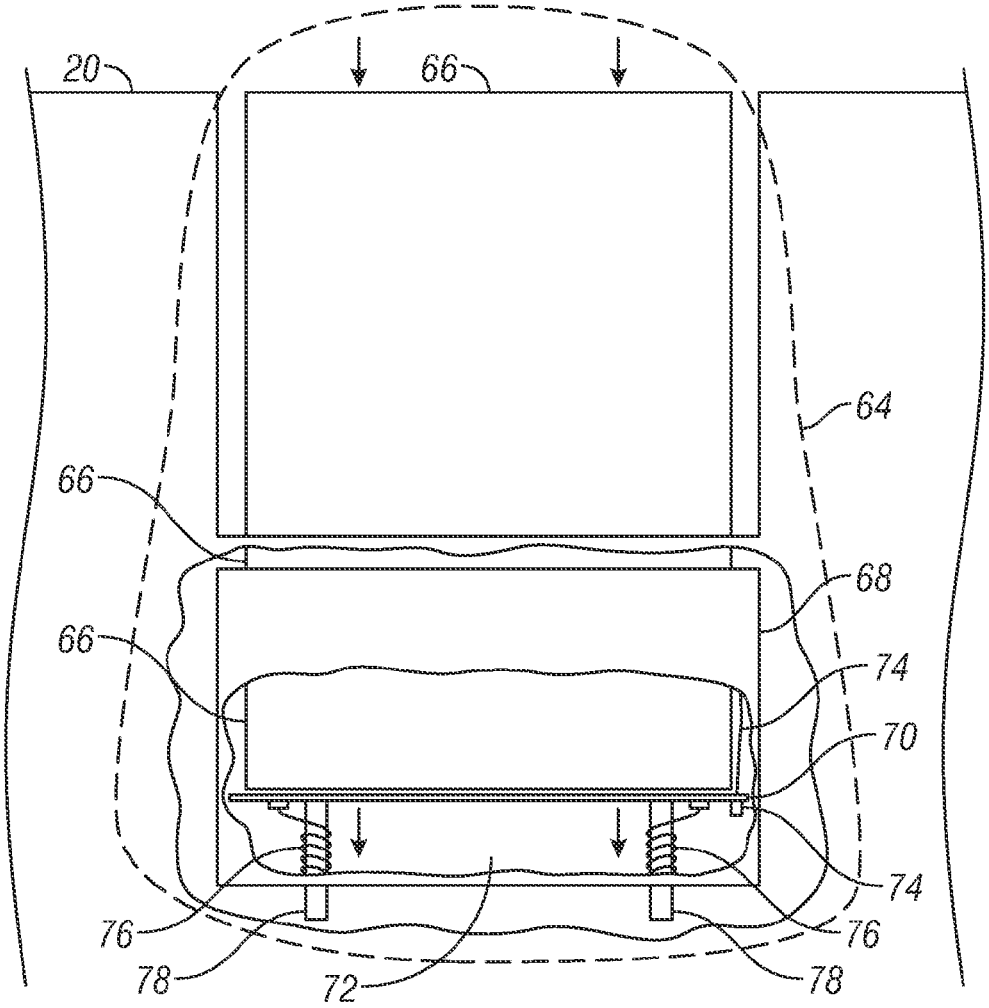
FIG. 10 is a schematic, fragmented, cutaway view illustrating yet another alternate embodiment of the actuator assembly of FIG. 1.

FIG. 10 is a schematic, fragmented, cutaway view illustrating another alternate embodiment 64 of actuator assembly 22 of FIG. 1. With continuing reference to FIGS. 1-10, alternate embodiment 64 is configured such that when actuated, a pushable member 66 is first pushed in a downward direction and then pushed in an outward direction to unlatch and open, respectively, vehicle door 20. In alternate embodiment 64, pushable member 66 is mounted by a mounting member 68 to vehicle door 20 in a position such that pushable member 66 is substantially flush with the portion of vehicle door 20. Mounting member 68 includes a platform 70 to support pushable member 66 and further includes a recess 72 to receive a lower portion of pushable member 66 when it is depressed during actuation. Alternate embodiment 64 further includes a latch engaging member 74 attached to platform 70. When the user 38 depresses pushable member 66 in a downward direction, latch engaging member 74 pulls on vehicle door latch 24, thus actuating it. Alternate embodiment 64 further includes a spring 76 attached to each support leg 78 of platform 70. Each spring 76 biases platform 70, and hence pushable member 66 in an upward direction towards a closed position. As user 38 depresses pushable member 66 downwardly, pushable member 66 moves to the opened position.

Figure 11:
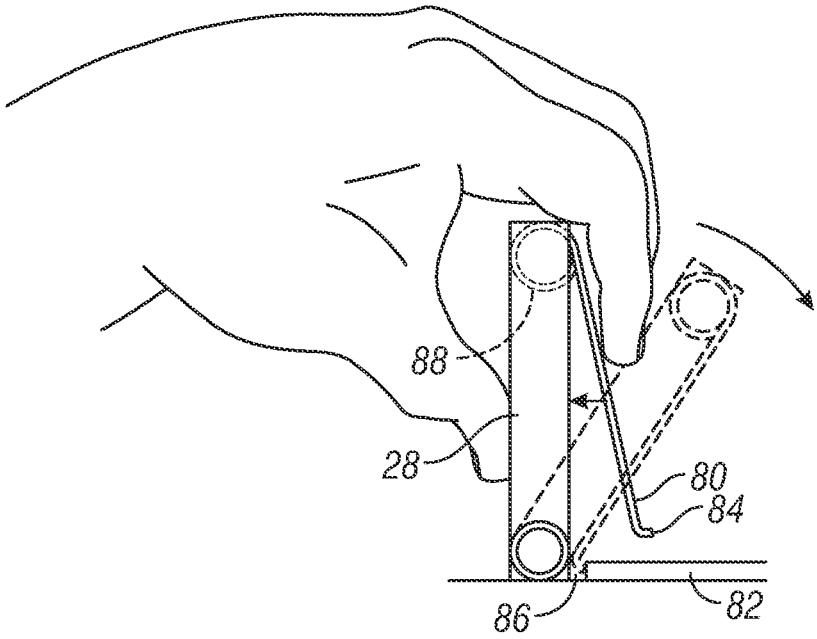
FIG. 11 is a schematic side view illustrating still another embodiment of the actuator assembly of FIG. 1.

FIG. 11 is a schematic side view illustrating another feature compatible for use with actuator assembly 22 of FIG. 1. With continuing reference to FIGS. 1-11, actuator assembly 22 further includes a blocking member 80. Blocking member 80 serves as an interlock that obstructs unintended movement of pushable member 28 from the closed position. Blocking member 80 is configured to move between a blocking position, shown in solid lines, and a non-blocking position shown in phantom lines.

While blocking member 80 is in the blocking position, an end portion 84 of blocking member 80 will engage a platform 82 as pushable member 28 is pushed an inboard direction. This engagement will inhibit movement of pushable member 28 from the closed position. When blocking member 80 is moved to the non-blocking position, end portion 84 of blocking member 80 will fit within a recess 86 between platform 82 and pushable member 28 and pushable member 28 may be pushed in an outboard direction.

To maintain blocking member 80 in a blocking position, a spring 88 is provided. Spring 88 engages pushable member 28 in blocking member 80 in a manner that biases blocking member 80 towards the blocking position. Thus, prior to actuating the actuator assembly, the user must first grasp the pushable member 28 between thumb and fingers and compress blocking member 80 towards the non-blocking position. The user may then actuate the actuator assembly in the manner described above.

Although the use of blocking member 80 has been shown in conjunction with pushable member 28 of actuator assembly 22, it should be understood that a blocking member such as blocking member 80 may be used together with each of the embodiments described above. It should also be understood that blocking member 80 may take any suitable configuration effective to allow blocking member 80 to serve as an interlock.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing the exemplary embodiment or exemplary embodiments. It should be understood that various changes can be made in the function and arrangement of elements without departing from the scope as set forth in the appended claims and the legal equivalents thereof.

What is claimed is:

1. An actuator assembly for a vehicle door latch, the actuator assembly comprising:

a pushable member configured for engagement by a user;

a mounting member connected to the pushable member and configured for connection to a vehicle door, the mounting member further configured to mount the pushable member to the vehicle door in a manner that enables the pushable member to be pushed by the user from a closed position to an open position; and a latch engaging member connected to the mounting member and configured for engagement with a latch of the vehicle door, the latch engaging member configured to move the latch from a latched position to an unlatched position when the pushable member moves from the closed position to the open position, whereby the user is enabled to both unlatch the vehicle door and open the vehicle door with a single pushing movement, wherein the latch engaging member comprises a cable, wherein the mounting member comprises a pivot, wherein the cable is mounted to the pivot, and wherein the cable is configured to wrap at least partially around the pivot as the pushable member moves from the closed position to the open position whereby the cable pulls on the latch of the vehicle door to move the latch from the latched position to the unlatched position.

2. The actuator assembly of claim 1, further comprising a stopping member configured to engage the pushable member and positioned to obstruct the pushable member from moving beyond the open position.

3. The actuator assembly of claim 1, wherein the mounting member comprises a pivot having a longitudinal axis, the pivot being configured to enable the pushable member to pivot between the closed position and the open position.

4. The actuator assembly of claim 3, wherein the longitudinal axis is oriented substantially vertically when the pivot is connected to the vehicle door.

5. The actuator assembly of claim 3, wherein the longitudinal axis is oriented substantially horizontally when the pivot is connected to the vehicle door.

6. The actuator assembly of claim 1, wherein the mounting member defines a recess configured to receive a portion of the pushable member and wherein the pushable member is configured to move into the recess when the pushable member moves from the closed position to the open position.

7. The actuator assembly of claim 1, wherein the pushable member and the mounting member comprise a single component.

8. An actuator assembly for a vehicle door latch, the actuator assembly comprising:

a pushable member configured for engagement by a user;

a mounting member connected to the pushable member and configured for connection to a vehicle door, the mounting member further configured to mount the pushable member to the vehicle door in a manner that enables the pushable member to be pushed by the user from a closed position to an open position;

a biasing member connected to the pushable member and configured to bias the pushable member towards the closed position; and a latch engaging member connected to the mounting member and configured for engagement with a latch of the vehicle door, the latch engaging member configured to move the latch from a latched position to an unlatched position when the pushable member moves from the closed position to the open position, whereby the user is enabled to both unlatch the vehicle door and open the vehicle door with a single pushing movement, wherein the latch engaging member comprises a cable, wherein the mounting member comprises a pivot, wherein the cable is mounted to the pivot, and wherein the cable is configured to wrap at least partially around the pivot as the pushable member moves from the closed position to the open position whereby the cable pulls on the latch of the vehicle door to move the latch from the latched position to the unlatched position.

9. The actuator assembly of claim 8, further comprising a first stopping member configured to engage the pushable member and positioned to obstruct the pushable member from moving beyond the closed position.

10. The actuator assembly of claim 9, further comprising a second stopping member configured to engage the pushable member and positioned to obstruct the pushable member from moving beyond the open position.

11. The actuator assembly of claim 8, wherein an inboard surface of the pushable member is substantially flush with a portion of the vehicle door when the pushable member is in the closed position.

12. The actuator assembly of claim 8, wherein the mounting member comprises a pivot having a longitudinal axis, the pivot being configured to enable the pushable member to pivot between the closed position and the open position.

13. The actuator assembly of claim 12, wherein the longitudinal axis is oriented substantially vertically when the pivot is connected to the vehicle door.

14. The actuator assembly of claim 12, wherein the longitudinal axis is oriented substantially horizontally when the pivot is connected to the vehicle door.

15. The actuator assembly of claim 8, wherein the mounting member defines a recess configured to receive a portion of the pushable member and wherein the pushable member moves into the recess when the pushable member moves from the closed position to the open position.

16. An actuator assembly for a vehicle door latch, the actuator assembly comprising:

a pushable member configured for engagement by a user;

a mounting member connected to the pushable member and configured for connection to a vehicle door, the mounting member further configured to mount the pushable member to the vehicle door in a manner that enables the pushable member to be pushed by the user from a closed position to an open position;

a blocking member connected to the pushable member and configured to move between a blocking position and a non-blocking position, the blocking member obstructing movement of the pushable member from the closed position when the blocking member is in the blocking position and the blocking member permitting movement of the pushable member from the closed position when the blocking member is in the non-blocking position; and a latch engaging member connected to the mounting member and configured for engagement with a latch of the vehicle door, the latch engaging member configured to move the latch from a latched position to an unlatched position when the pushable member moves from the closed position to the open position, whereby the user is enabled to both unlatch the vehicle door and open the vehicle door with a single pushing movement, wherein the latch engaging member comprises a cable, wherein the mounting member comprises a pivot, wherein the cable is mounted to the pivot, and wherein the cable is configured to wrap at least partially around the pivot as the pushable member moves from the closed position to the open position whereby the cable pulls on the latch of the vehicle door to move the latch from the latched position to the unlatched position.

17. The actuator assembly of claim 16 further comprising a first biasing member connected to the blocking member and configured to bias the blocking member towards the blocking position.

18. The actuator assembly of claim 16, further comprising a second biasing member connected to the pushable member and configured to bias the pushable member towards the closed position.

* * * * *